US006520746B2

(12) United States Patent
Yoo et al.

(10) Patent No.: US 6,520,746 B2
(45) Date of Patent: Feb. 18, 2003

(54) APPARATUS AND METHOD FOR CONTROLLING OPERATION OF RECIPROCATING COMPRESSOR

(75) Inventors: Jae Yoo Yoo, Kwangmyung (KR); Hyung Jin Kim, Seoul (KR); Kye Si Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/962,076

(22) Filed: Sep. 26, 2001

(65) Prior Publication Data

US 2002/0051710 A1 May 2, 2002

(30) Foreign Application Priority Data

Sep. 27, 2000 (KR) ..... 00-56731
Jan. 9, 2001 (KR) ..... 01-1144
Jan. 9, 2001 (KR) ..... 01-1145

(51) Int. Cl.[7] ..... F04B 49/06

(52) U.S. Cl. ..... 417/44.11; 417/53; 417/44.1; 417/417; 417/45; 417/18; 417/212

(58) Field of Search ..... 417/53, 44.1, 45, 417/18, 44.11, 212, 417

(56) References Cited

U.S. PATENT DOCUMENTS 4,783,807 A * 11/1988 Marley ..... 381/43
5,947,693 A * 9/1999 Yang ..... 417/45
5,980,211 A * 11/1999 Tojo et al. ..... 417/45
6,084,320 A * 7/2000 Morita et al. ..... 310/12
6,153,951 A * 11/2000 Morita et al. ..... 310/12
6,176,683 B1 * 1/2001 Yang ..... 417/44.1
6,231,310 B1 * 5/2001 Tojo et al. ..... 417/44.1
6,289,680 B1 * 9/2001 Oh et al. ..... 62/6

* cited by examiner

*Primary Examiner*—Charles G. Freay
*Assistant Examiner*—W Rodriguez
(74) *Attorney, Agent, or Firm*—Fleshner & Kim, LLP

(57) ABSTRACT

In an apparatus and a method for controlling operation of a reciprocating compressor which is capable of operating a compressor stably by detecting a phase difference and using an inflection point of the phase difference, an apparatus and a method for controlling operation of a reciprocating compressor including an electric circuit unit operating a reciprocating compressor by varying a stroke with motion of a piston, a phase difference detecting unit detecting a phase difference of a current and a voltage from the electric circuit unit, a phase inflection point detecting unit detecting a phase inflection point by being inputted the phase difference, and a stroke controlling unit being inputted the detected phase inflection point from the phase inflection point detecting unit and applying a voltage, to the electric circuit unit in order to make the stroke correspond to the phase inflection point can control a TDC of a piston regardless of load variation, improve an operation efficiency of a reciprocating compressor, and because a stroke calculating circuit is not required, there is no stroke calculating error according to the motor constant variation, in addition, it is possible to operate a reciprocating compressor by corresponding instantly to a load and operate the reciprocating compressor in a safe region in sensing of an overload by grasping the present load condition using a reference value of a phase difference.

39 Claims, 14 Drawing Sheets

APPARATUS AND METHOD FOR CONTROLLING OPERATION OF RECIPROCATING COMPRESSOR

BACKGROUND OF THE INVENTION

1. Field of the Invention

The present invention relates to an apparatus and a method for controlling operation of a reciprocating compressor operating a compressor by being inputted a certain stroke command value, and in particular to an apparatus and a method for controlling operation of a reciprocating compressor which is capable of operating a reciprocating compressor stably by detecting a phase difference of a current and a voltage and a phase difference of a current and a velocity and using an inflection point of the phase difference.

2. Description of the Prior Art

Generally, a compressor is for pressurizing refrigerant vapor (compressing refrigerant vapor) in order to make condensing of refrigerant vapor evaporated in a vaporizer easier. By the operation of the compressor, heat can be transmitted from a cold side to a warm side by a refrigerant circulating inside a refrigerating apparatus while repeating a condensing and a vaporizing processes.

These days various types of compressors are used, among them a reciprocating compressor is generally used. The reciprocating compressor pressurizes vapor by a piston moving up and down inside a cylinder, particularly when the reciprocating compressor is used for a refrigerator or an air conditioner, a pressure ratio can be varied by varying a stroke voltage applied to the reciprocating compressor, accordingly it is advantageous to a variable refrigerating capacity control.

FIG. 1 is a block diagram illustrating a construction of an apparatus for controlling operation of a reciprocating compressor in accordance with the prior art. As depicted in FIG. 1, an apparatus for controlling operation of a reciprocating compressor includes a voltage/current detecting unit 13 detecting a voltage and a current generated in a reciprocating compressor, a stroke calculating unit 11 calculating a stroke (a distance between a top dead center and a bottom dead center of a piston) by using the voltage and the current detected in the voltage/current detecting unit 13 and outputting it, a comparator 10 comparing the calculated stroke with a certain stroke command value inputted by a user and outputting a comparison signal according to the comparison result, a stroke controller 12 increasing or decreasing a stroke voltage according to the comparison signal from the comparator 10 and outputting it, a microcomputer 14 outputting a switching control signal according to the stroke voltage outputted from the stroke controller 12, and an electric circuit unit 15 applying a certain voltage to the reciprocating compressor according to a switching control signal of the microcomputer 14.

The control operation of the reciprocating compressor in accordance with the prior art will be described.

In the reciprocating compressor, when a stroke voltage is outputted by being inputted a certain stroke command value from a user, a stroke (a distance between a top dead center and a bottom dead center of the piston) is varied by an up and down motion of a piston of a cylinder, a refrigerating gas inside the cylinder is transmitted to a condenser through a discharge valve, accordingly a refrigerating capacity can be adjusted.

Herein, as depicted in FIG. 2, according to the increase of the stroke by the stroke voltage, when the voltage and the current generated in the reciprocating compressor are detected and applied to the stroke calculating unit 11 as shown at step ST10, the stroke calculating unit 11 calculates a stroke by using the voltage and the current detected from the voltage/current detecting unit 13 as shown at step ST11. Accordingly, the comparator 10 is inputted, compares the stroke command value with the stroke calculated in the stroke calculating unit 11 and applies a comparison value to the stroke controller 12 as shown at step ST12, and the stroke controller 12 varies the stroke voltage according to the comparison value and applies it to the microcomputer 14 as shown at step ST13. After, the microcomputer 14 outputs a switching control signal by the voltage applied from the stroke controller as shown at step ST14 and operates the reciprocating compressor as shown at step ST15.

Herein, when the stroke value calculated in the stroke calculating unit 11 is smaller than the stroke command value, the stroke controller 12 increases a stroke voltage, when the stroke value calculated in the stroke calculating unit 11 is larger than the stroke command value, the stroke controller 12 decreases a stroke voltage and applies it to the microcomputer 14.

Herein, the stroke calculating unit 11 is inputted a motor constant $\alpha$ (constant for converting an electric power into a mechanical power), $R_{ac}$ (a loss value due to resistance such as a copper loss or an iron loss), a voltage $V_M$ between both ends of a motor, etc. and calculates a velocity of a piston and a stroke by below equations.

$$\text{Velocity}=V_M-R_{ac}i-L\ di/di$$

$$\text{Stroke}=1/\alpha\int(\text{Velocity})dt$$

In the meantime, a stroke of a triac of the electric circuit unit 15 is increased by lengthening a turn on cycle according to a switching control signal of the microcomputer 14, herein the voltage and the current generated in the reciprocating compressor are separately detected in the voltage/current detecting unit 13 and are applied to the stroke calculating unit 11.

Then, the stroke calculating unit 11 calculates a stroke by using the voltage and the current detected from the voltage/current detecting unit 13, the calculated stroke is compared with the stroke command value in the comparator 10 the comparison result is outputted to the stroke controller 12, the stroke controller 12 increases or decreases the stroke voltage, the microcomputer 14 is inputted the stroke voltage outputted from the stroke controller 12 and outputs a switching control signal for controlling a reciprocating compressor to the reciprocating compressor.

In more detail, when the calculated stroke is smaller than the stroke command value, the microcomputer 14 increases a stroke voltage applied to the reciprocating compressor by outputting a switching control signal for lengthening an turn on cycle of the triac, when the calculated stroke is larger than the stroke command value, the microcomputer 14 decreases a stroke voltage applied to the reciprocating compressor by outputting a switching control signal for shortening a turn on cycle of the triac.

In the meantime, the microcomputer 14 detects a load (the outdoor temperature or a condenser temperature, etc.) by installing a sensor at the circumstances of a compressor or a circuit unit of a refrigerator and uses it as basic information for precision control of a refrigerator. For example, the microcomputer 14 detects the temperature through a sensor installed at the surface of the condenser and detects a load.

However, the apparatus and the method for controlling operation of the reciprocating compressor in accordance with the prior art has a serious nonlinearity in the mechanical motion characteristic aspect due to difficulties in measuring accurate current and voltage caused by loss such as a motor constant or a copper loss or an iron loss, it is impossible to perform a precise control with the control method not considering the nonlinearity, in load detecting for precise control of the compressor, the outdoor temperature or a temperature of a condenser is measured through a sensor installed on the surface, after examining each load condition different control algorithm has to be applied according to each condition, accordingly a time delay occurs and the load can not be accurately detected due to the time delay.

In addition, because a reciprocating compressor is controlled with a fixed stroke, a TDC (Top Dead Center) is varied according to increase or decrease of load of a refrigerator. And, because the reciprocating compressor is operated by a quantitative control (control using a constant value required for converting an electric power into a mechanical power, a loss value due to resistance such as a copper loss or an iron loss, an inductance, a current, a voltage between both ends of a motor, etc.), a refrigerating capacity is varied according to characteristics of a motor constant and an apparatus, lots of error elements occur in stroke calculation, accordingly an operation efficiency of the reciprocating compressor is low.

SUMMARY OF THE INVENTION

Accordingly, it is an object of the present invention to provide an apparatus and a method for controlling operation of a reciprocating compressor which is capable of performing a TDC (Top Dead Center) control of a piston by using an inflection point about phase difference of an input voltage and a current.

It is another object of the present invention to provide a method for controlling operation of a reciprocating compressor which is capable of performing a precise control by determining an operation mode by detecting a load with a reference value of a phase difference of a voltage and a current.

It is still another object of the present invention to provide a method for detecting a phase of a reciprocating compressor which is capable of detecting precisely a phase difference of two signals and reducing a cost by detecting a phase of a signal by a digital mode.

In order to achieve the above-mentioned objects of the present invention, an apparatus for controlling operation of a reciprocating compressor in accordance with the present invention includes an electric circuit unit operating a reciprocating compressor by varying a stroke by motion of a piston, a phase difference detecting unit detecting a phase difference about a current and a voltage from the electric circuit unit, a phase inflection point detecting unit detecting a phase inflection point by being inputted the phase difference, and a stroke controlling unit being inputted the phase inflection point detected from the phase inflection point detecting unit and applying a stroke voltage corresponded to the phase inflection point to the electric circuit unit.

In order to achieve the above-mentioned objects, a method for controlling operation of a reciprocating compressor in accordance with the present invention includes a first process for operating a reciprocating compressor for a certain time with a fixed stroke and detecting a phase difference of a voltage and a current at the operation, a second process for judging whether a reference value of a phase difference in the first process is larger or smaller than a certain value ($\alpha\beta$: $\alpha<\beta$), a third process for performing avoidance operation of the reciprocating compressor according to a stroke tremble while operating the reciprocating compressor with a fixed stroke when the reference value of the phase difference is smaller than the certain value ($\alpha$) in the judging result, a fourth process for performing avoidance operation of the reciprocating compressor according to a stroke tremble while operating the reciprocating compressor with a fixed stroke when the reference value of the phase difference is larger than the certain value ($\beta$) in the judging result, and a fifth process for performing avoidance operation of the reciprocating compressor according to a stroke tremble and a size of a refrigerating capacity while operating the reciprocating compressor with a stroke having a phase inflection point when the reference value of the phase difference is between certain values ($\alpha$, $\beta$: $\alpha<\beta$) in the judging result, In order to achieve the above-mentioned objects, a method for detecting a phase of a reciprocating compressor includes a first process for detecting first and second zero voltages by sampling a first and a second analog signals with a certain sampling cycle, a second process for generating a first and a second phase signals using the first and the second zero voltages detected in the first process, and a third process for detecting a phase difference signal by performing a logical operation of the first and the second phase signals generated in the second process.

DETAILED DESCRIPTION OF THE PREFERRED EMBODIMENT

Figure 1:
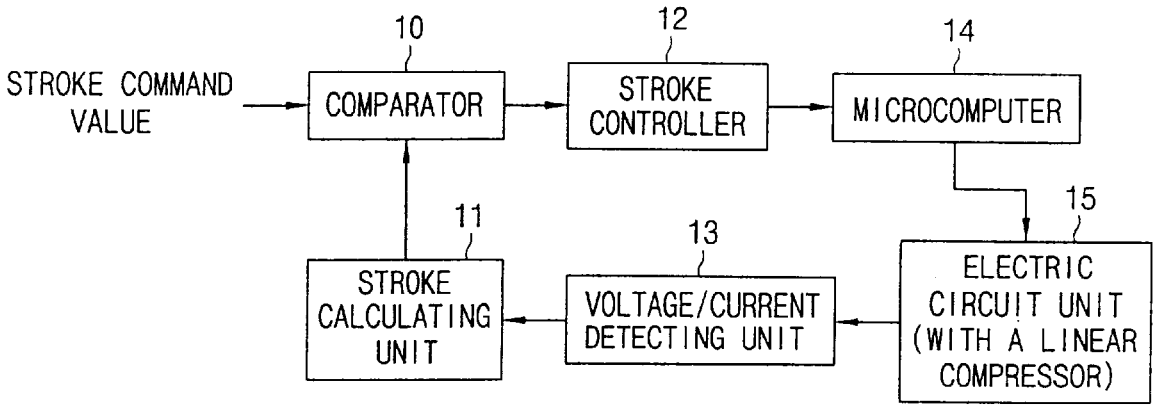
FIG.1 CONVENTIONAL ART
FIG. 1 is a block diagram illustrating a construction of an apparatus for controlling operation of a reciprocating compressor in accordance with the prior art.
Figure 2:
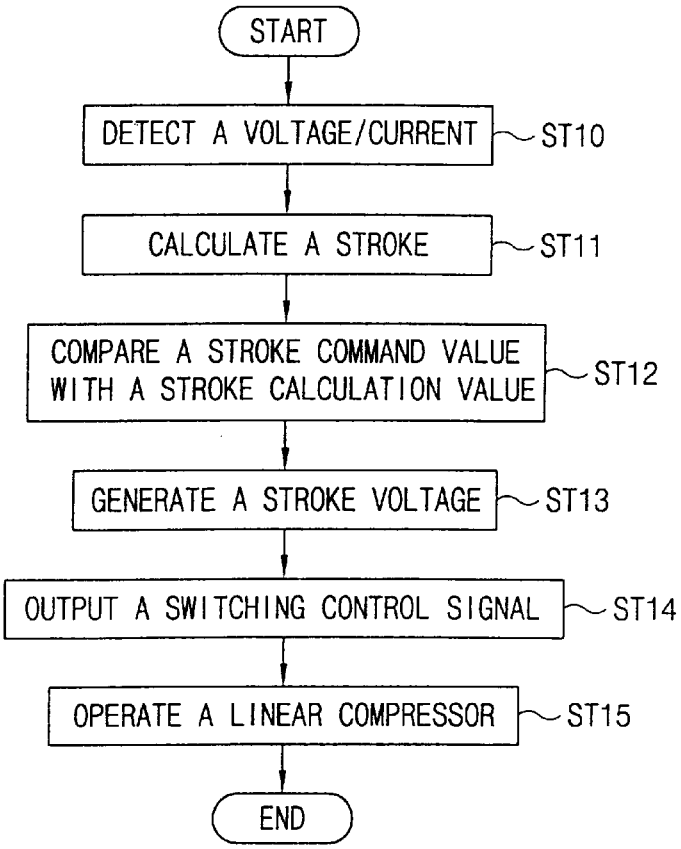
FIG.2 CONVENTIONAL ART
FIG. 2 is a flow chart illustrating a method for controlling operation of a reciprocating compressor in accordance with the prior art.
Figure 3:
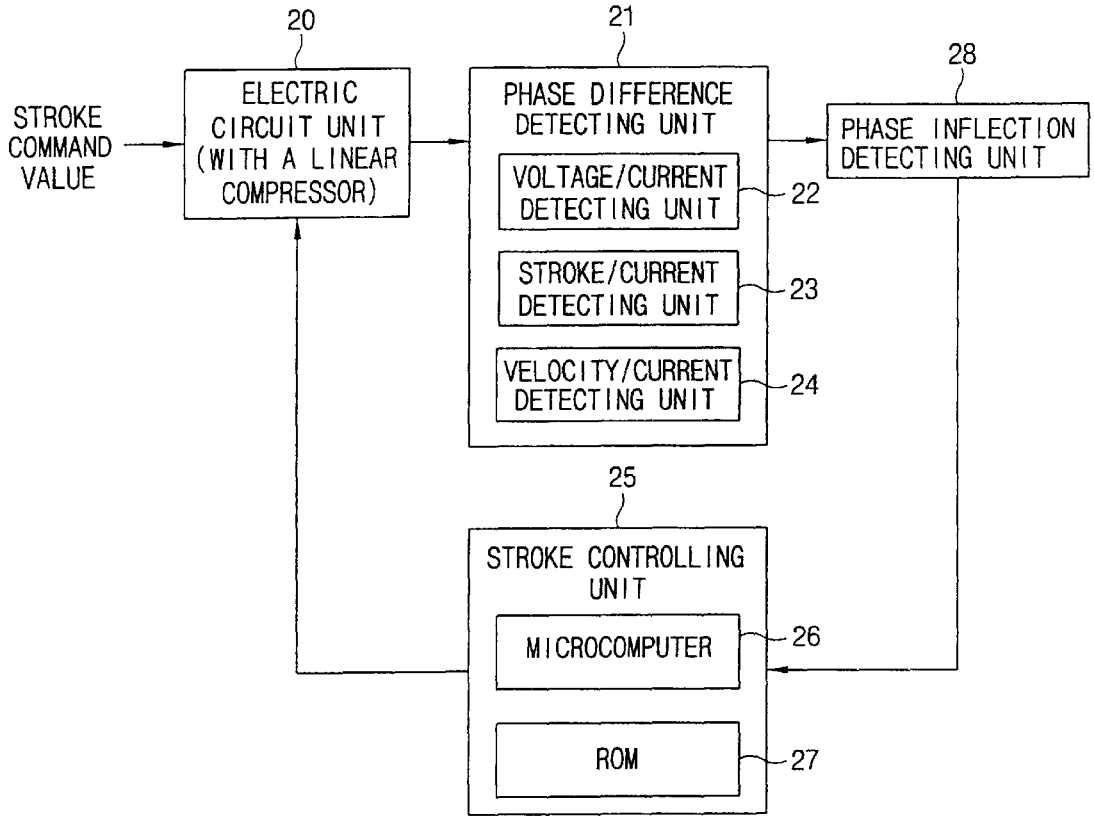
FIG. 3 is a block diagram illustrating a construction of an apparatus for controlling operation of a reciprocating compressor in accordance with the present invention.

FIG. 3 is a block diagram illustrating a construction of an apparatus for controlling operation of a reciprocating compressor in accordance with the present invention, an apparatus for controlling operation of a reciprocating compressor in accordance with the present invention comprises an electric circuit unit 20 operating a reciprocating compressor by varying a stroke with a motion of a piston, a phase difference detecting unit 21 detecting a phase difference by being inputted a current and a voltage from the electric circuit unit 20, a phase inflection point detecting unit 28 detecting a phase inflection point by being inputted the phase difference from the phase difference detecting unit 21, and a stroke controlling unit 25 being inputted the phase inflection point detected from the phase inflection detecting unit 28 and applying a stroke voltage corresponded to the phase inflection point to the electric circuit unit 20.

Herein, the electric circuit unit 20 operates the reciprocating compressor by intermittently transmitting an AC power with a triac by being inputted a stroke voltage from the electric circuit unit 20, the phase difference detecting unit 21 includes a voltage/current detecting unit 22 detecting a voltage and a current generated in the reciprocating compressor by the stroke variation of the reciprocating compressor, the phase inflection point detecting unit 28 detects a phase inflection point as a TDC (Top Dead Center) is 0 by being inputted the voltage/current phase difference from the phase difference detecting unit 21 and comparing it with a previous detected voltage/current phase difference, and the stroke controlling unit 25 includes a microcomputer 26 outputting a switching control signal by a stroke voltage corresponded to the phase inflection point detected from the phase inflection point detecting unit 28 and a ROM (Read Only Memory) 27 storing in advance a stroke voltage value corresponded to the voltage/current phase difference. Herein, instead of the voltage/current detecting unit 22 detecting the voltage and the current, a stroke/current detecting unit 23 detecting a stroke and a current or a velocity/current detecting unit 24 detecting a velocity and a current can be used.

The operation of the apparatus for controlling operation of the reciprocating compressor in accordance with the present invention will be described.

First, by applying the stroke voltage to make a TDC as 0, a refrigerating capacity is adjusted by varying a stroke by the motion of a piston of a cylinder. Herein, according to the variation of the stroke by the stroke voltage, the voltage/current detecting unit 22 detects the voltage and the current generated in the reciprocating compressor and applies them to the phase difference detecting unit 21. According to this, the phase difference detecting unit 21 is inputted the detected voltage and current from the voltage/current detecting unit 22 and detects a voltage/current phase difference at a corresponded time point. In addition, in stead of detecting a voltage/current phase difference through the voltage/current detecting unit 22, a stroke/current phase difference can be detected through the stroke/current detecting unit 23, and a velocity/current phase difference can be detected through the velocity/current detecting unit 24.

Then, the phase inflection point detecting unit 28 is inputted a present voltage/current phase difference from the phase difference detecting unit 21 and compares it with a voltage/current phase difference detected in a previous cycle. Herein, when the present voltage/current phase difference is smaller than the previous voltage/current phase difference, a stroke voltage is increased, when the present voltage/current phase difference is larger than the previous voltage/current phase difference, a phase inflection point is detected by decreasing the stroke voltage.

After, the stroke controlling unit 25 is inputted the detected phase inflection point from the phase inflection point detecting unit 28, applies a stroke voltage corresponded to the phase inflection point to the reciprocating compressor and controls the reciprocating compressor so as to operate in a point in which a TDC is '0', when a stroke tremble occurs in the point in which the TDC is '0', the stroke controlling unit 25 performs an avoidance operation-above and below the point in which the TDC is '0'.

Figure 4:
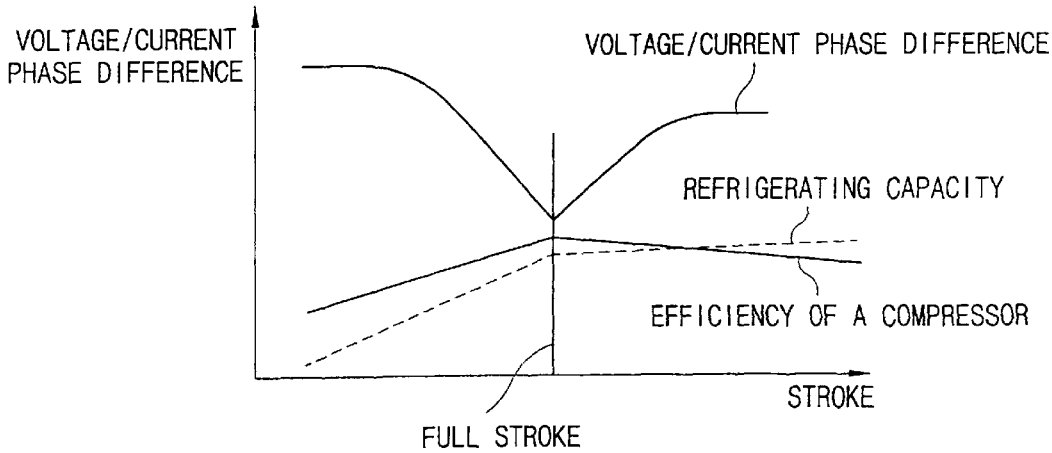
FIG. 4 is a graph illustrating a voltage/current phase difference, a refrigerating capacity and a compressor efficiency according to increase of a stroke voltage in accordance with the present invention.
Figure 5:
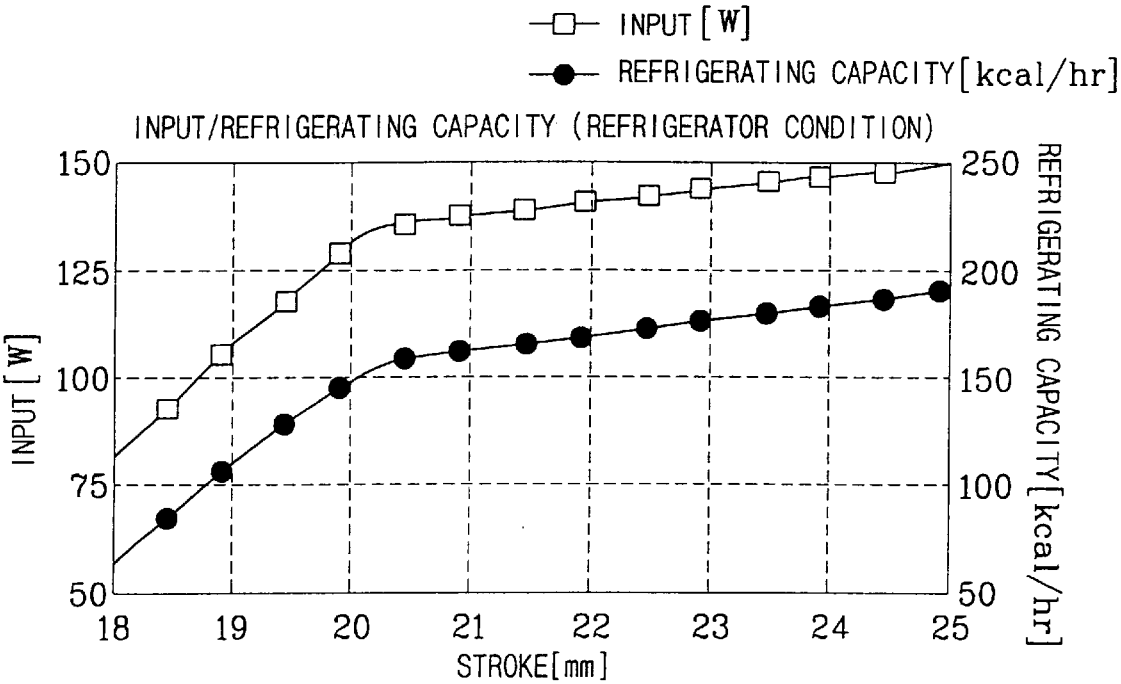
FIG. 5 is a graph illustrating generation of an inflection point according to a refrigerator condition among compressor efficiency measuring conditions in accordance with the present invention.
Figure 5:
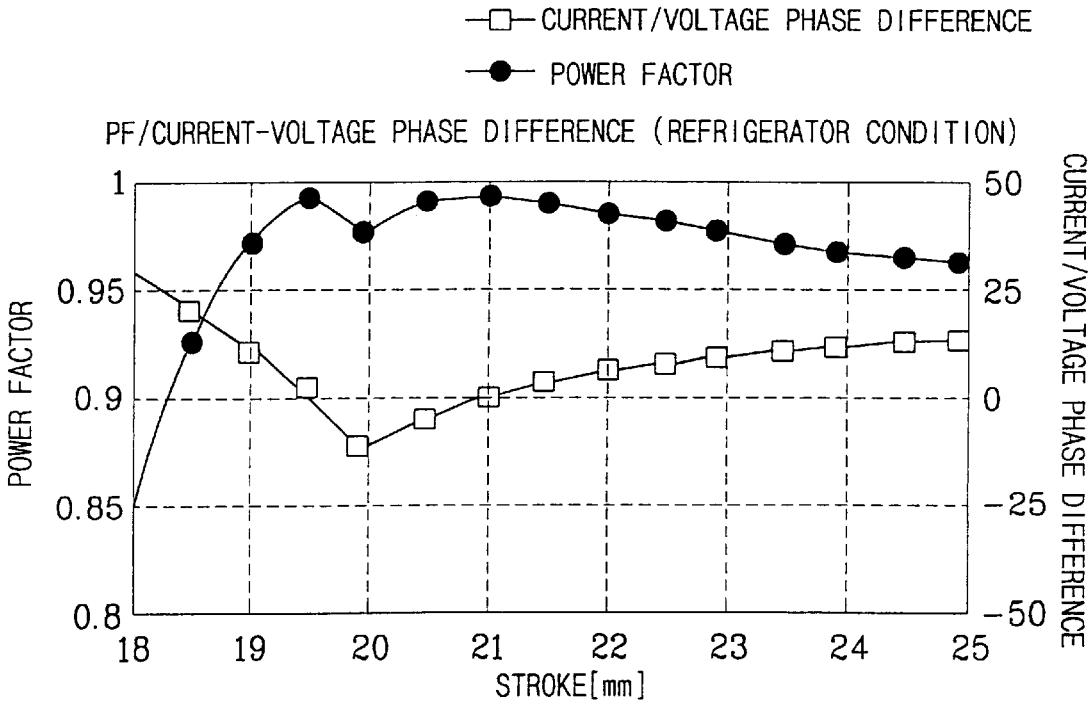
Figure 6:
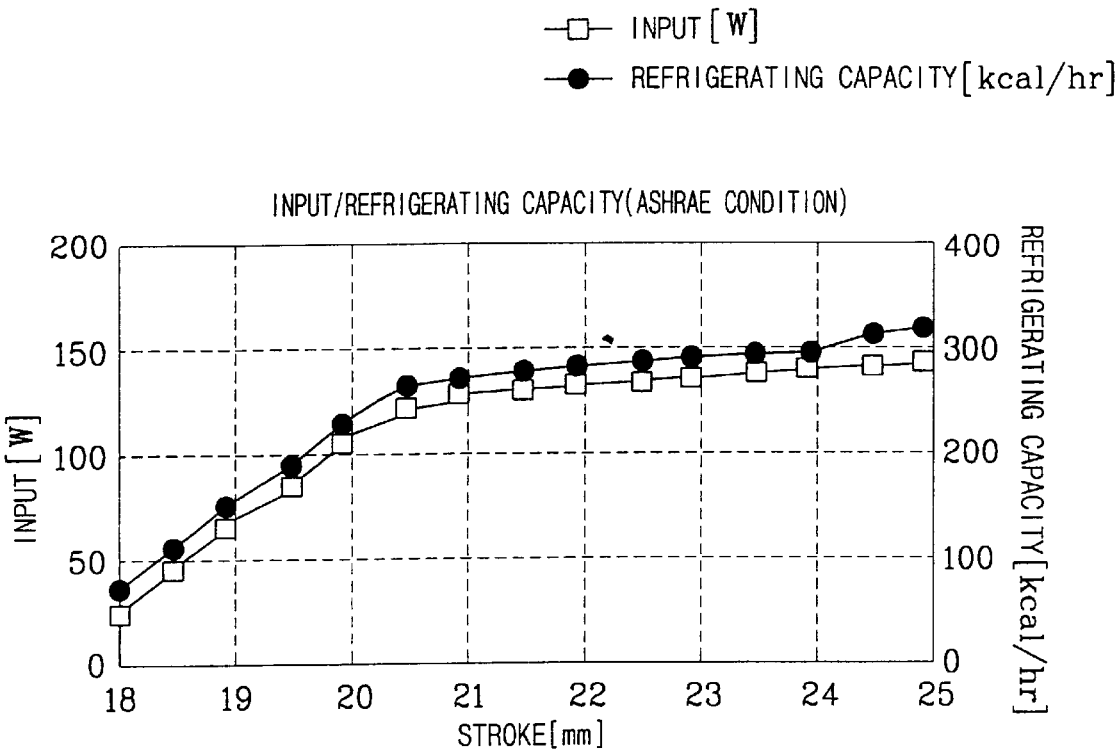
FIG. 6 is a graph illustrating generation of an inflection point according to an ASHRAE condition among compressor efficiency measuring conditions in accordance with the present invention.
Figure 6:
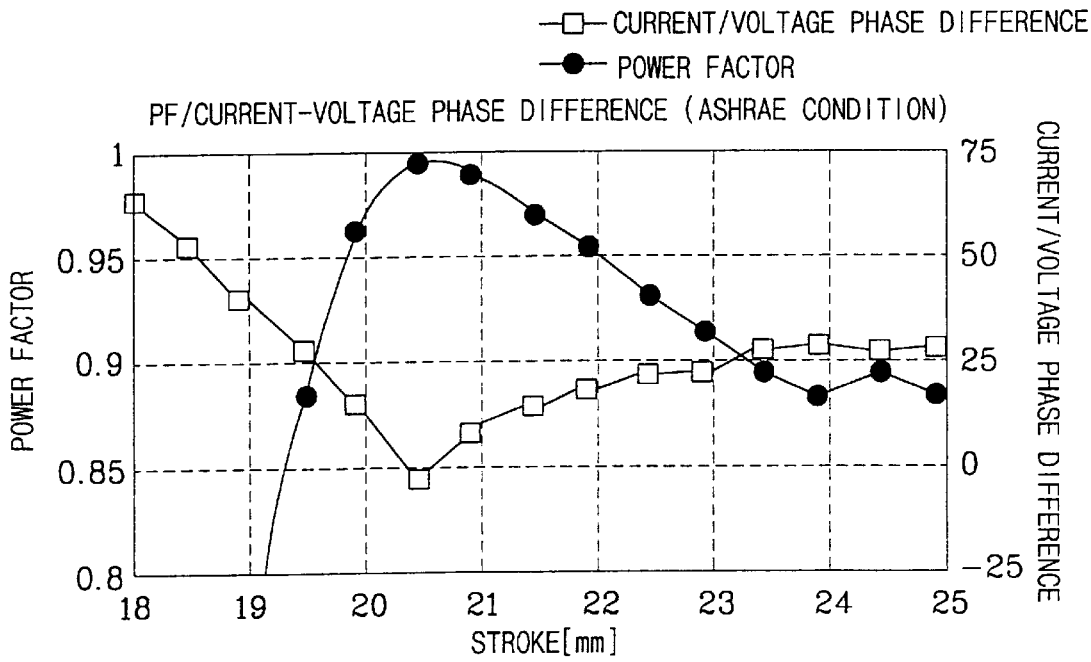

FIG. 4 is a graph illustrating a voltage/current phase difference, a refrigerating capacity and a compressor efficiency according to the increase of a stroke voltage in accordance with the present invention. As depicted in FIG. 4, an inflection point (a point in which a voltage/current phase difference increases right after decrease) occurs according to the increase of the stroke voltage. In addition, the inflection point of the voltage/current phase difference is a point as the TDC is '0' and means an optimum condition. Accordingly, a refrigerating capacity is not increased although the compressor is operated at a point not smaller than the inflection point. As well as FIG. 4, as depicted in FIGS. 5 and 6, in compressor efficiency measuring conditions such as a refrigerator condition and an ASHRAE condition, an inflection point occurs according to the increase of the stroke voltage.

In more detail, when a phase difference of an input voltage and a current is detected and a stroke is controlled at a point as the TDC of the piston is '0' by using an inflection point about the phase difference, there is no need to calculate values for stroke calculation (for example, a motor constant, a loss value due to resistance such as a copper loss or an iron loss, an inductance, a current, a voltage between both ends of a motor, etc.), it is possible to perform a TDC control of the piston by a qualitative control (control using characteristics of a compressor) regardless of the load variation.

Figure 7:
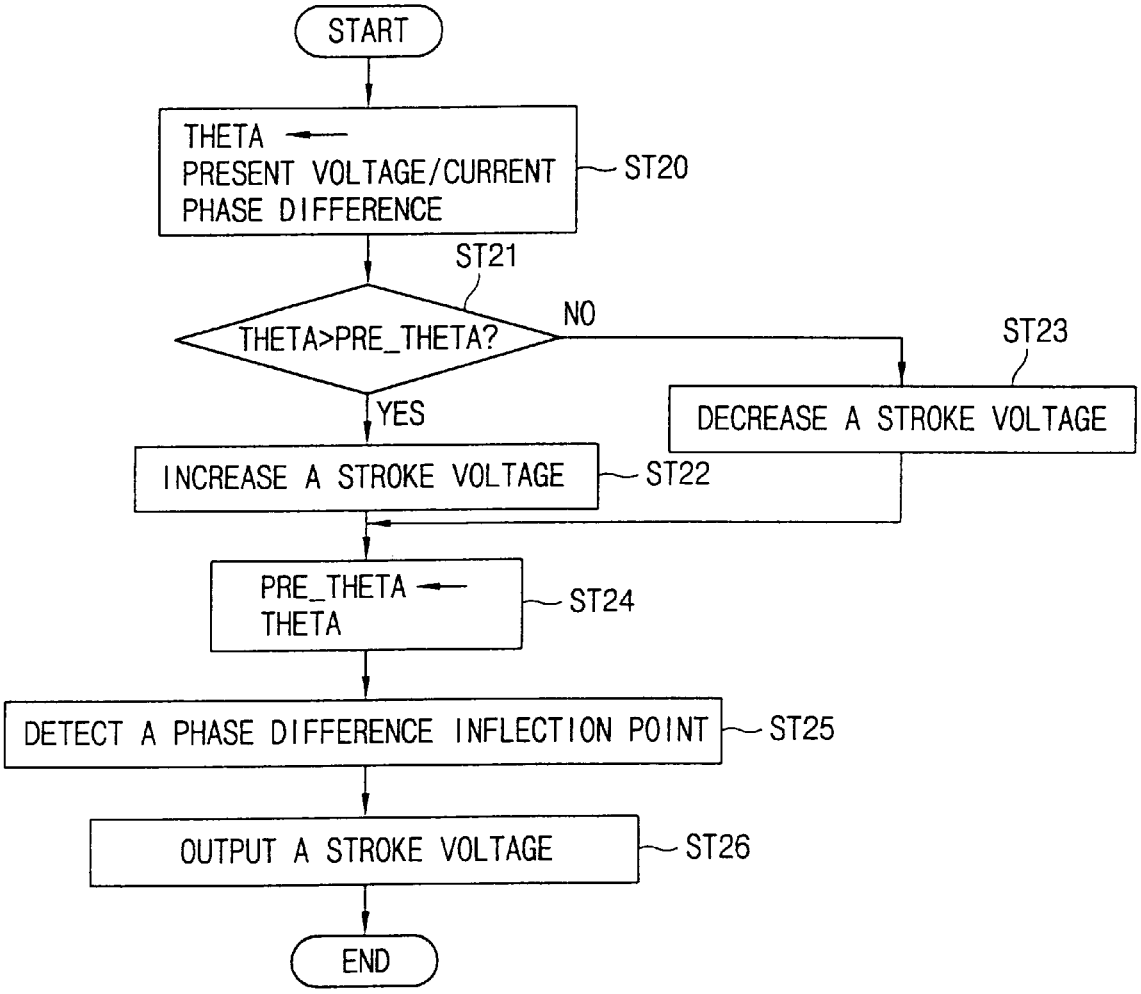
FIG. 7 is a flow chart illustrating a method for controlling operation of a reciprocating compressor controlling a refrigerating capacity by varying a stroke with a motion of a piston according to a certain stroke command value in accordance with the present invention.

FIG. 7 is a flow chart illustrating a method for controlling operation of a reciprocating compressor controlling a refrigerating capacity by varying a stroke with a motion of a piston according to a certain stroke command value in accordance with the present invention. As depicted in FIG. 7, a method for controlling operation of a reciprocating compressor includes detecting a voltage/current phase difference by detecting a voltage and a current generated in a reciprocating compressor as shown at step ST20, comparing the detected voltage/current phase difference (THETA) with a previous detected voltage/current phase difference (PRE_THETA) as shown at ST21, when the present voltage/current phase difference (THETA) is larger than the voltage/current phase difference of the previous cycle (PRE_THETA) in the comparing result, decreasing a stroke voltage and storing the present voltage/current phase difference as the previous value as shown at steps ST23 and ST24, when the present voltage/current phase difference (THETA) is smaller than the voltage/current phase difference of the previous cycle (PRE_THETA) in the comparing result, increasing the stroke voltage and storing the present voltage/current phase difference as the previous value as shown at steps ST22 and ST24, detecting a phase inflection point as the TDC is '0' according to the voltage/current phase difference stored in the storing process as shown at step ST25, and outputting a stroke voltage corresponded to the phase inflection point detected in the detecting process to the reciprocating compressor as shown at step ST26. Herein, in the detecting and comparing processes, instead of detecting the phase difference of the voltage and the current, a phase difference of a velocity and a current or a phase difference of a stroke and a current can be detected.

In the embodiment of the present invention, the operation of the reciprocating compressor at a phase inflection point as a point in which the TDC is '0' is described. However, when a tremble of a refrigerator occurs, the stroke controlling unit controls a refrigerating capacity within a certain range not causing a tremble by varying the stroke on the basis of an inflection point and performing an avoidance operation (it is called as a variable capacity control).

For example, when a user sets a stroke value, in order to operate the compressor with an optimum efficiency, a TDC value always has to be 0 regardless of a size of load.

However, when a load is too big in the operation of the compressor, a TDC is a plus value, when a load is too small, a TDC is a minus value, accordingly a reliance problem in TDC control may occur due to the load variation.

Figure 8:
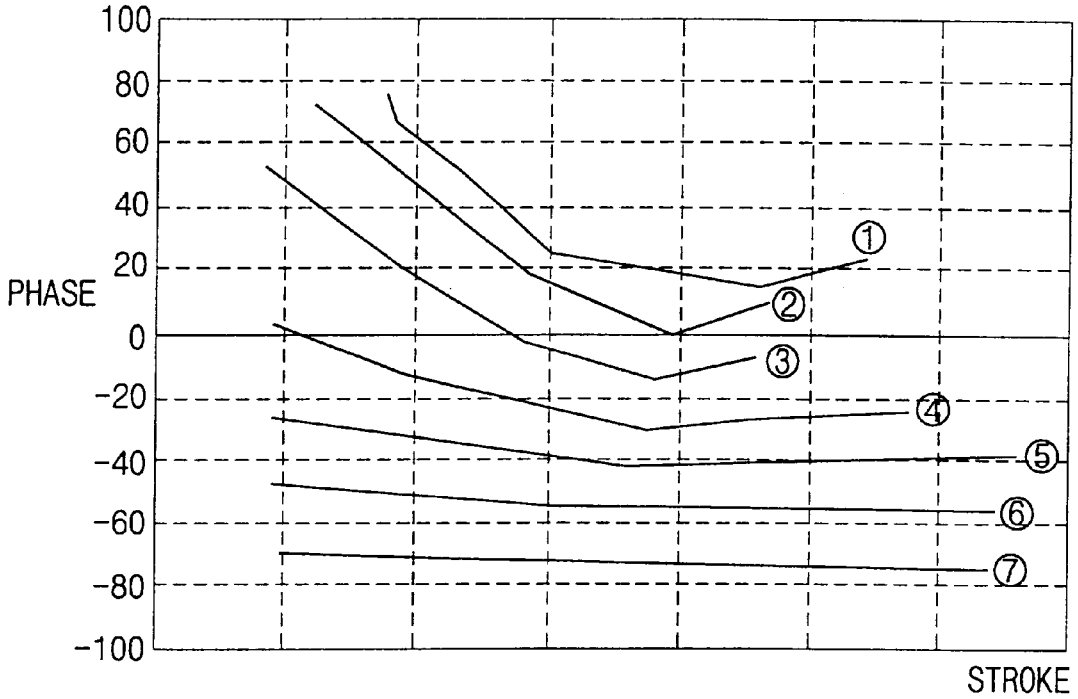
FIG. 8 is a graph illustrating a state of an inflection point according to a size of a load in accordance with the present invention.

Accordingly, by operating the reciprocating compressor by dividing regions into an inflection point existence region and an inflection point non-existence region according to the load variation in the operation of the reciprocating compressor, the reciprocating compressor can be reliably operated. In more detail, as depicted in FIG. 8, the reciprocating compressor is controlled by using an inflection point in inflection point existence regions (2,3,4,5) when it is difficult to detect an inflection point because the load is too small (6,7), the reciprocating compressor is controlled with a pre-stored certain stroke, when an inflection point does not exist because the load is too big, the reciprocating compressor is controlled with a pre-stored certain stroke.

Figure 9A:
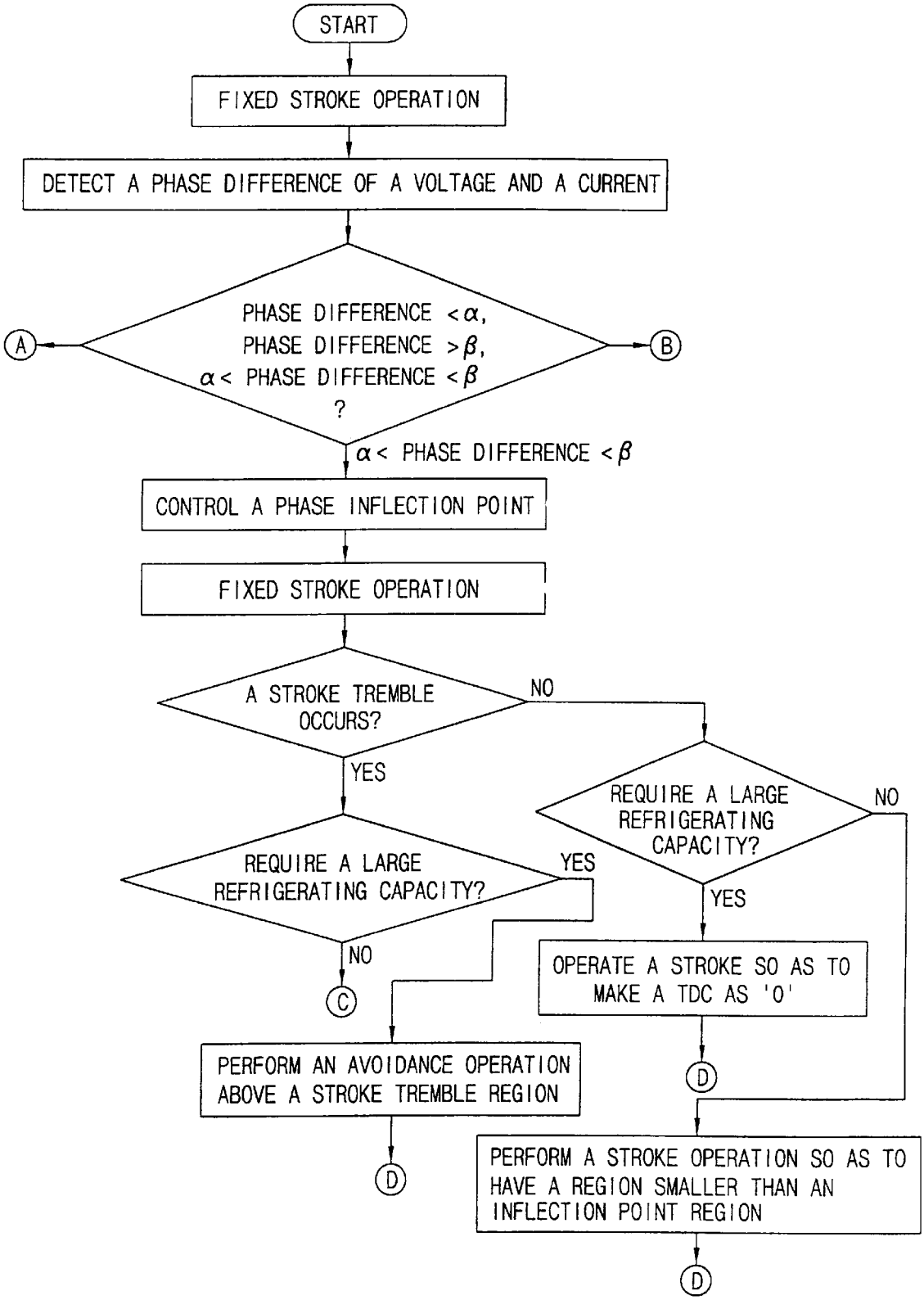
FIGS. 9A, 9B and 9C are a flow chart illustrating a method for operating a reciprocating compressor with a reference value of a phase difference of a voltage and a current generated in the operation of the reciprocating compressor in accordance with the present invention.
Figure 9B:
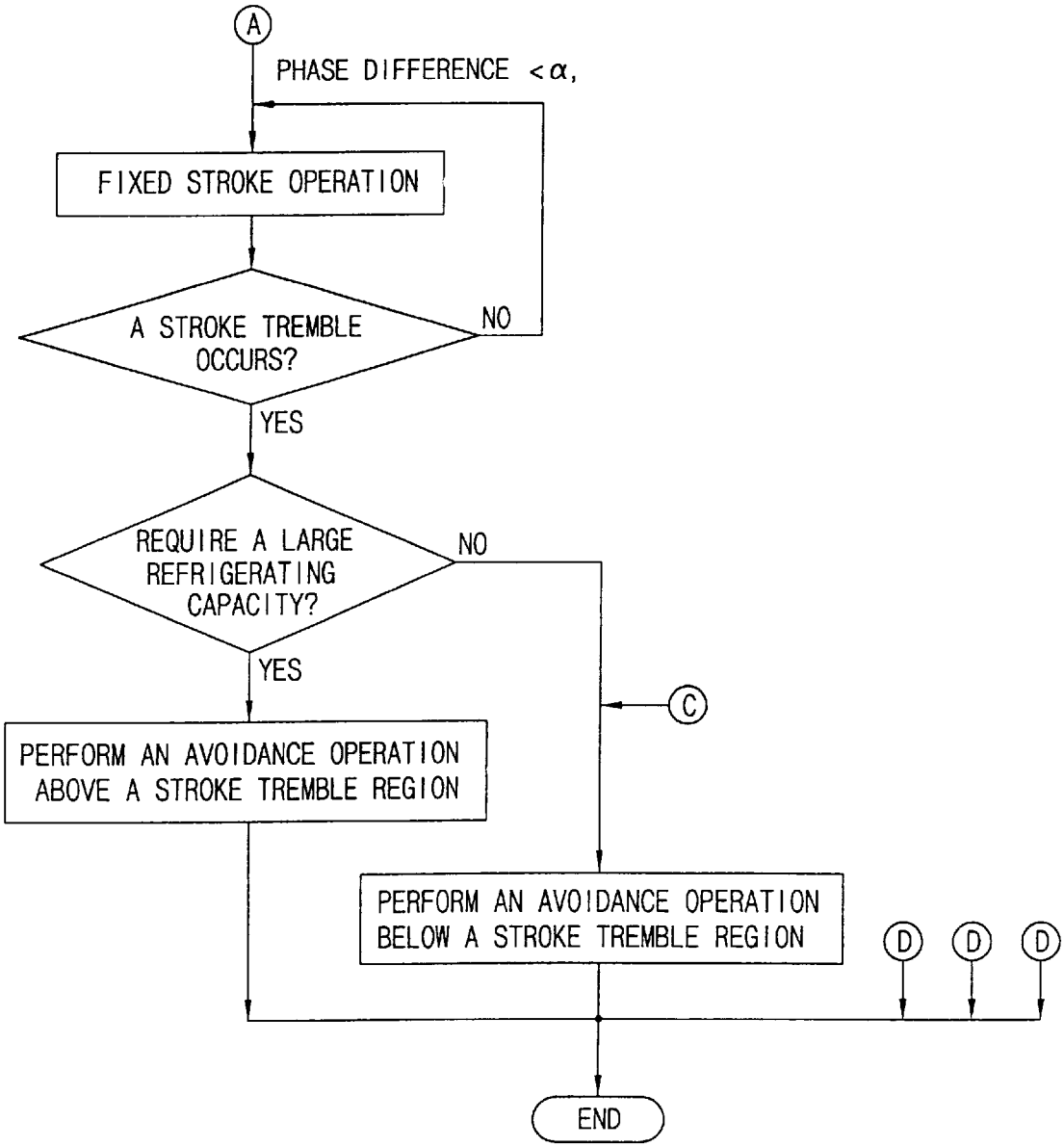
Figure 9C:
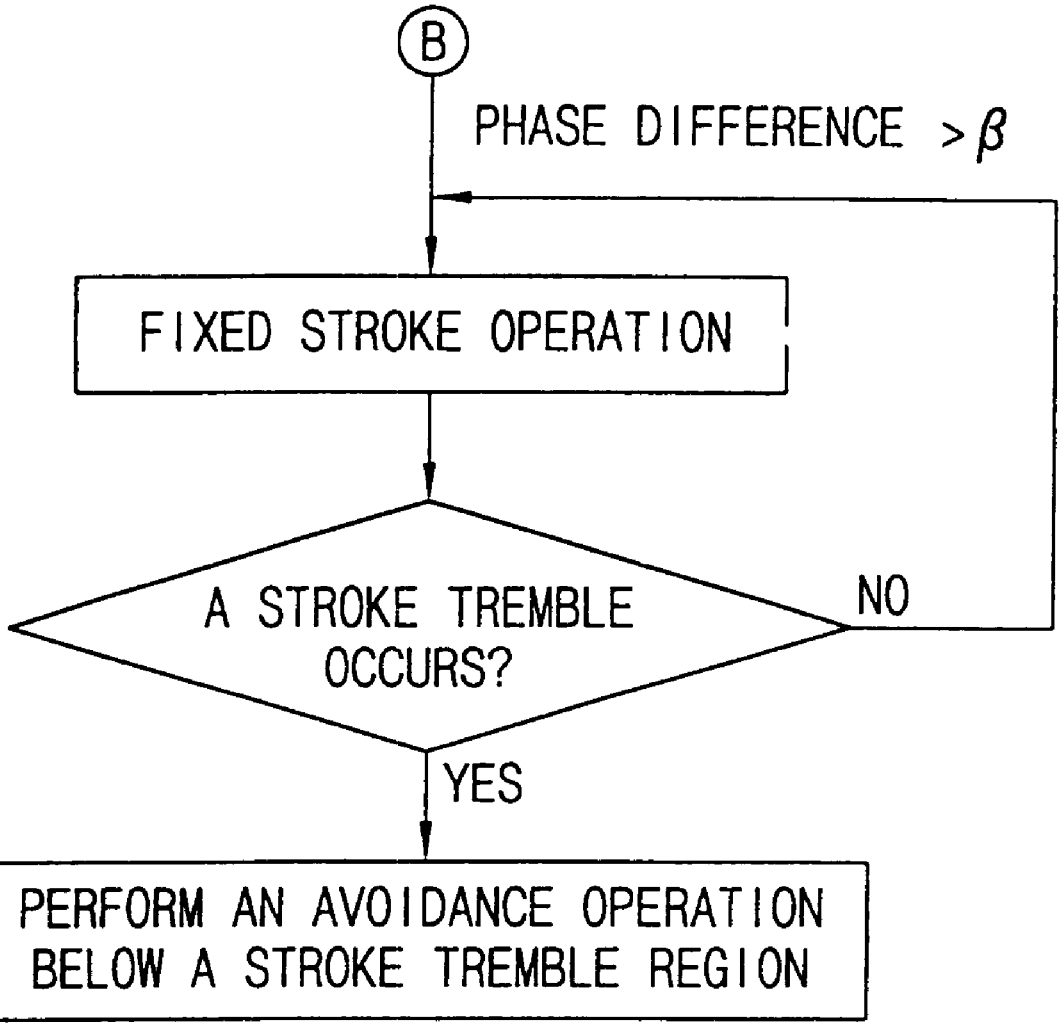

FIGS. 9A, 9B and 9C are a flow chart illustrating a method for operating a reciprocating compressor with a reference value of a phase difference of a voltage and a current generated in the operation of the reciprocating compressor in accordance with the present invention. As depicted in FIGS. 9A, 9B and 9C, it is possible to perform a precise control of a reciprocating compressor by a first process for detecting a phase difference of a voltage and a current at the operation time while operating a reciprocating compressor with a fixed stroke for a certain time, a second process for judging whether a reference value of the phase difference in the detecting process is larger or smaller than a certain value ($\alpha$, $\beta$: $\alpha<\beta$), when the reference value of the phase difference is smaller than the certain value ($\alpha$) in the judging result, a third process for performing an avoidance operation according to a stroke tremble and a refrigerating capacity while operating the reciprocating compressor with the fixed stroke, when the reference value of the phase difference is smaller than the certain value ($\beta$) in the judging result, a fourth process for performing an avoidance operation according to a stroke tremble and a refrigerating capacity while operating the reciprocating compressor with the fixed stroke, when the reference value of the phase difference is between the certain values ($\alpha$, $\beta$: $\alpha<\beta$) in the judging result, a fifth process for performing an avoidance operation according to a stroke tremble and a refrigerating capacity while operating the reciprocating compressor with a stroke having an inflection point.

Herein, the third process includes a first step for judging whether a stroke tremble occurs while operating the reciprocating compressor with the fixed stroke, a second step for judging whether a large refrigerating capacity is required when the stroke tremble occurs in the judging result of the first step, and a third step for performing an avoidance operation above the stroke tremble region when a large refrigerating capacity is required in the judging result of the second step and performing an avoidance operation below the stroke tremble region when a small refrigerating capacity is required in the judging result of the second step.

The fourth process includes a first step for judging whether a stroke tremble occurs in the operation of the reciprocating compressor with the fixed stroke, and a second step for performing an avoidance operation below the stroke tremble region when the stroke tremble occurs.

The fifth process includes a first step for judging whether a stroke tremble occurs while operating the reciprocating compressor with a stroke having an inflection point, a second step for performing an avoidance operation above the stroke tremble region when the stroke tremble occurs and a large refrigerating capacity is required in the judging result of the first step and performing an avoidance operation below the stroke tremble region when the stroke tremble occurs and a small refrigerating capacity is required in the judging result of the first step, and a third step for performing a stroke operation so as to make a TDC as 0 when the stroke tremble does not occur and a large refrigerating capacity is required in the judging result of the step 1 and performing a stroke operation so as to have a region smaller than an inflection point region when the stroke tremble does not occur and a small refrigerating capacity is required in the judging result of the step 1. Herein, in the phase inflection point control, when the present phase difference of the stroke and the current is larger than the previous phase difference of the stroke and the current, the stroke voltage is decreased, when the present phase difference of the stroke and the current is smaller than the previous phase difference of the stroke and the current, the stroke voltage is increased.

In the meantime, a method for detecting a phase difference in the phase detecting unit 21 will be described.

Figures 10A, 10B:
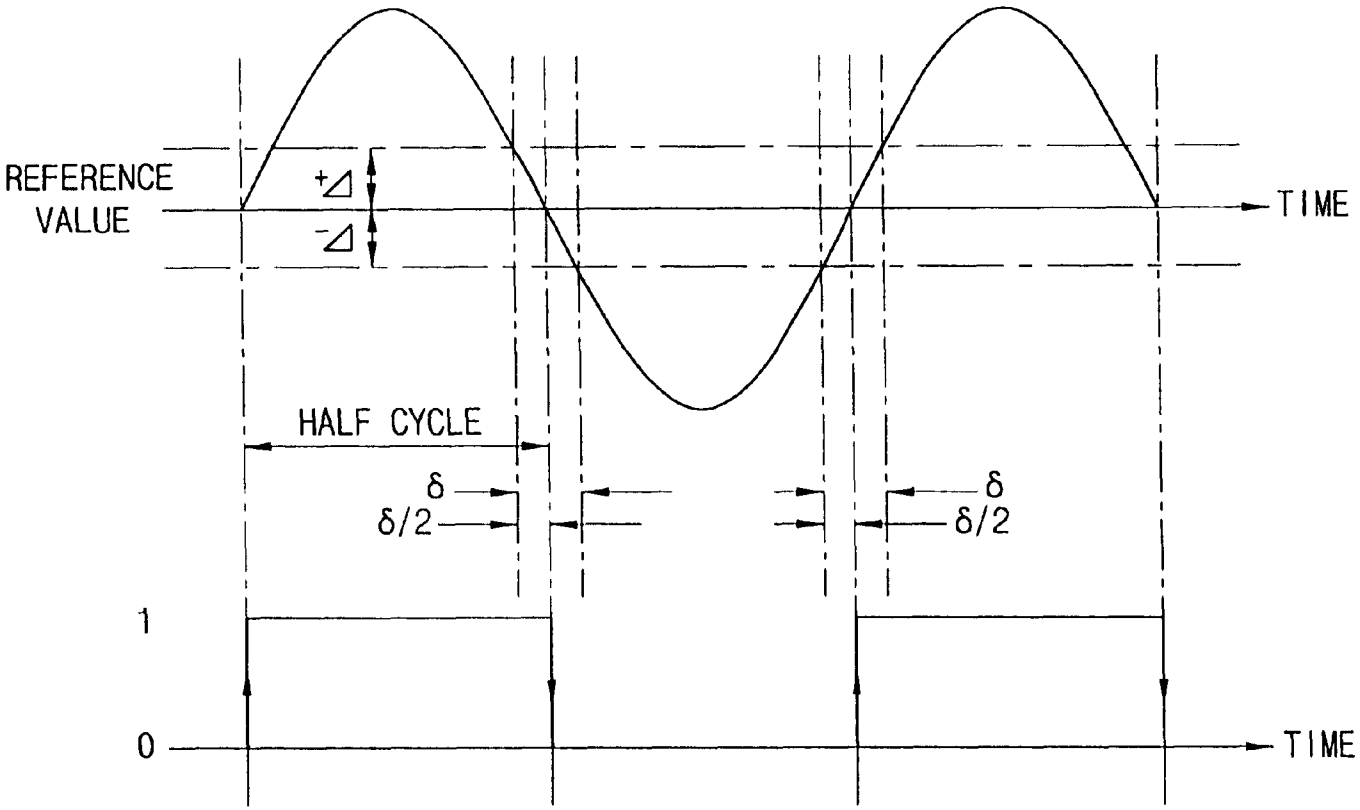
FIG. 10A is a waveform diagram illustrating a signal as a sine wave.
FIG. 10B is a waveform diagram illustrating a digital-like phase signal about a zero voltage detecting waveform when a signal is a sine wave.
Figures 11A, 11B:
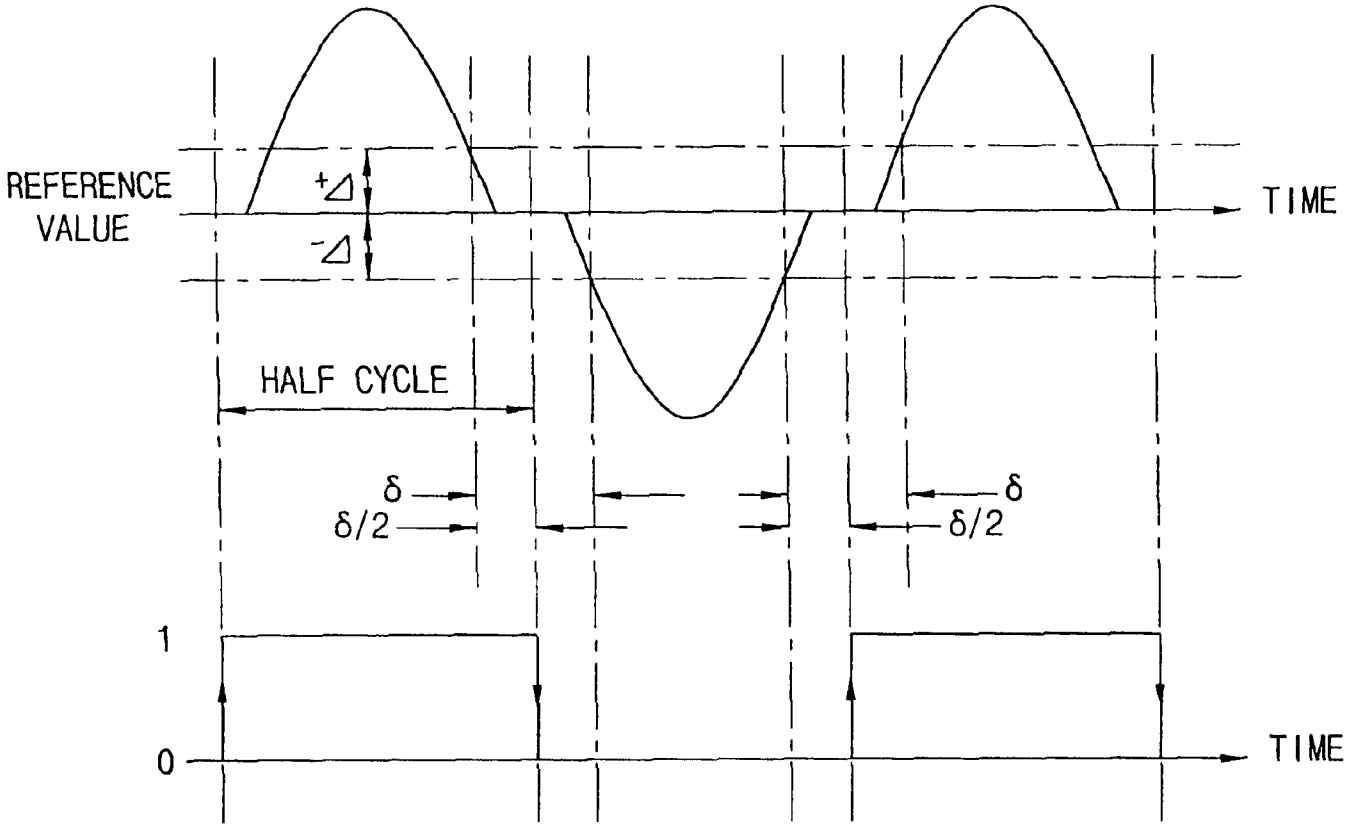
FIG. 11A is a waveform diagram illustrating a regular signal not a sine wave.
FIG. 11B is a waveform diagram illustrating a digital-like phase signal about a zero voltage detecting waveform when a signal is a regular signal not a sine wave.
Figure 12:
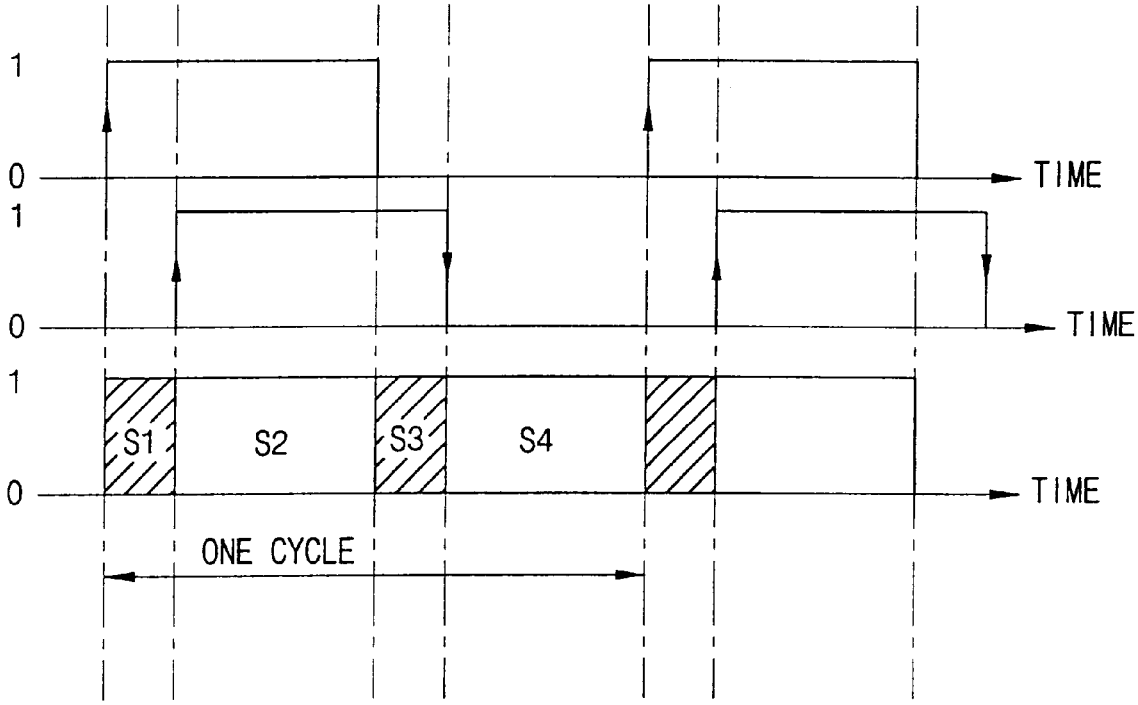
FIG. 12 is a graph illustrating a method for calculating a phase difference by being inputted two waveforms in accordance with the present invention.

First, as depicted in FIGS. 10A and 11A, when a time between a reference value $+\Delta$ and a reference value $-\Delta$ about a certain waveform is calculated and is called as $\delta$, by making a rising edge or a falling edge place at an intermediate value ($\delta/2$), a waveform as depicted in FIGS. 10B and 11B can be gotten. After, by using a waveform of FIGS. 10B and 11B, a waveform of FIG. 12 is gotten. Accordingly, in the phase difference about the two waveforms, a phase difference of a reciprocating compressor can be calculated by dividing the area of the phase difference signal (S1+S3)

by the total area of the phase difference signal (S1+S2+S3+S4) about one cycle.

Figure 13:
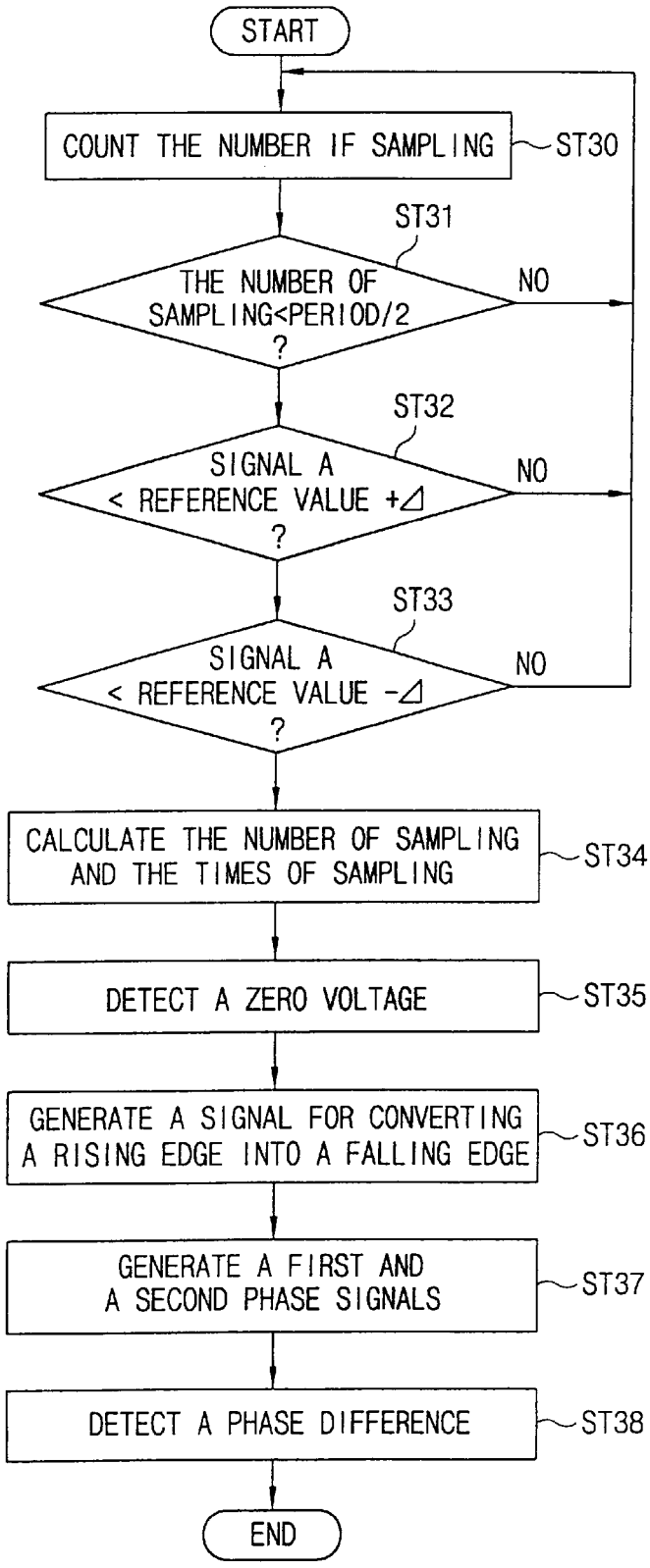
FIG. 13 is a flow chart illustrating a method for detecting a phase of a reciprocating compressor in accordance with the present invention.

FIG. 13 is a flow chart illustrating a method for detecting a phase of a reciprocating compressor in accordance with the present invention. As depicted in FIG. 13, it comprises a first process for detecting a first and a second zero voltages by sampling a first and a second analog signals with a certain sampling cycle as shown at steps ST30–ST35, a second process for generating a first and a second phase signals with the first and the second zero voltages detected in the first process as shown at steps ST36 and ST37, and a third process for detecting a phase signal by performing a certain logical operation about the first and the second phase signals generated in the second process as shown at step ST38.

Herein, the first process includes a first step for judging whether an analog signal is smaller than a 'reference value +Δ' when the number of sampling is smaller than a half cycle in the counting of the number of sampling, a second step for judging whether the analog signal is larger than a 'reference value −Δ' when the analog signal is smaller than the 'reference value +Δ', a third step for storing the number of sampling between the 'reference value −Δ' and 'reference value +Δ' and times of sampling, and a fourth step for detecting a zero voltage by dividing the number of sampling of the third step by the times of sampling.

The second process includes a first step for generating a signal varied into a rising edge or a falling edge at the first and the second zero voltage positions, and a second step for adding a half cycle to the signal generated in the first step, generating a signal having a edge opposed to the signal generated in the first step and detecting a first and a second phase signals corresponded to the generated signal.

Figure 14:
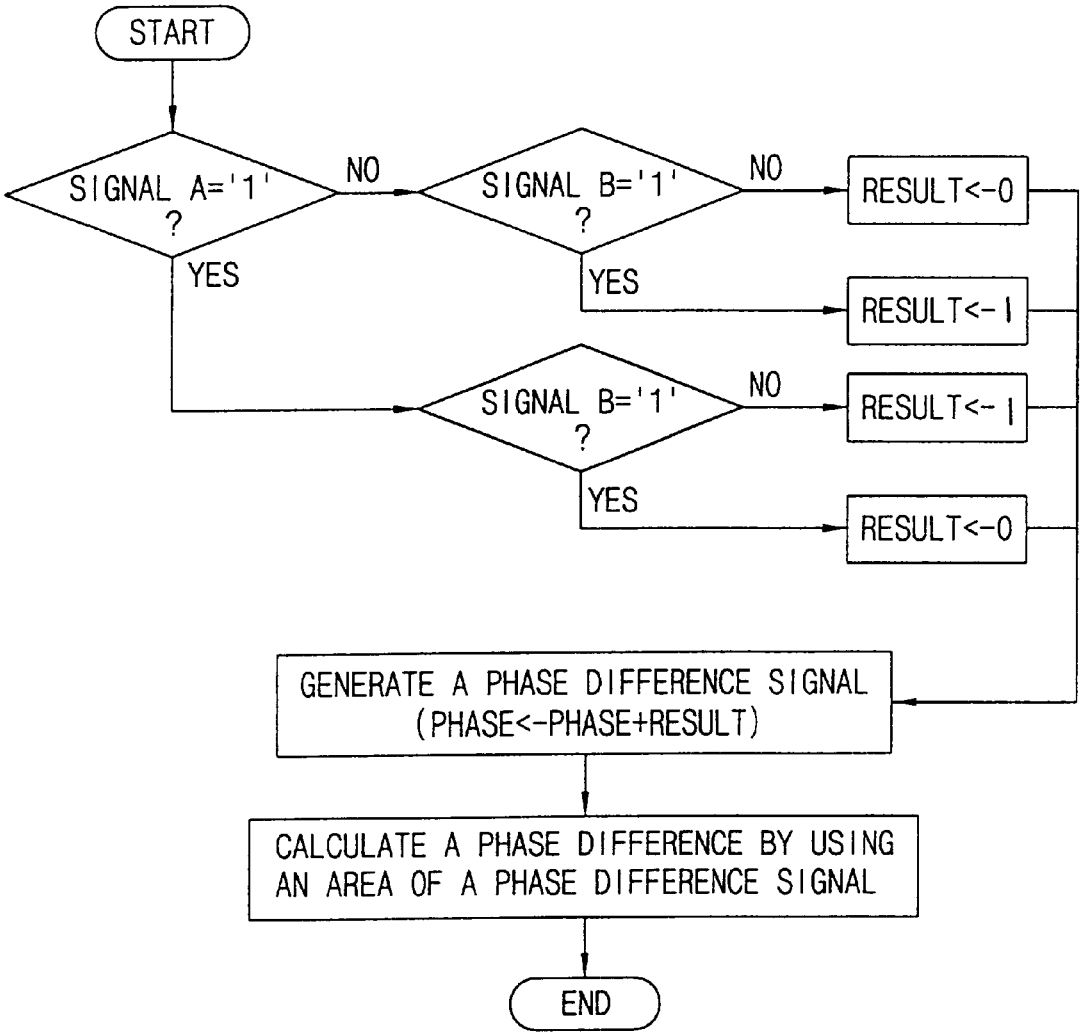
FIG. 14 is a flow chart illustrating a method for generating a phase difference signal by an exclusive or operation in accordance with the present invention.

As depicted in FIG. 14, in the phase signal of the third process, a phase signal is generated by performing an EXCLUSIVE OR operation of the first and second phase signals. In addition, in the phase signal of the third process, a phase signal of the reciprocating compressor can be detected by performing an AND operation or OR operation of the first and the second phase signals. Accordingly, by calculating a phase difference of a reciprocating compressor by dividing the area of the phase signal (S1+S3) by the total area of the phase signal about one cycle (S1+S2+S3+S4), an error due to noise or load variation can be reduced and a phase difference of two signals can be precisely detected.

As described above, it is possible to improve an operation efficiency of a reciprocating compressor by controlling a TDC (top dead center) of a piston regardless of load variation by controlling the TDC of the piston with an inflection point of phase difference, because a stroke calculating circuit is not required, there is no stroke calculating error according to the motor constant variation, in addition, it is possible to operate a reciprocating compressor by corresponding instantly to a load and operate the reciprocating compressor in a safe region in sensing of overload by grasping the present load condition by using a reference value of a phase difference.

What is claimed is:

1. An apparatus for controlling operation of a reciprocating compressor, comprising:

an electric circuit unit operating a reciprocating compressor by varying a stroke with motion of a piston;

a phase difference detecting unit detecting a phase difference of a current and a voltage from the electric circuit unit;

a phase difference inflection point detecting unit detecting a phase difference inflection point by being inputted the phase difference from the phase difference detecting unit; and a stroke controlling unit being inputted the detected phase difference inflection point from the phase difference inflection point detecting unit and applying a voltage to the electric circuit unit in order to make a stroke correspond to the phase difference inflection point.

2. The apparatus of claim 1, wherein the electric circuit unit operates the reciprocating compressor by intermittently transmitting an AC power using a triac.

3. The apparatus of claim 1, wherein the phase difference detecting unit includes a voltage/current detecting unit detecting a voltage and a current generated in the reciprocating compressor by the stroke variation of the reciprocating compressor.

4. The apparatus of claim 1, wherein the phase difference inflection point detecting unit detects a phase difference inflection point in which a TDC (Top Dead Center) is almost 0 by being inputted a voltage/current phase difference of the phase difference detecting unit and comparing it with a previous detected voltage/current phase difference.

5. The apparatus of claim 1, wherein the stroke controlling unit includes a microcomputer outputting a switching control signal to make the stroke correspond to the phase difference inflection point.

6. The apparatus of claim 1, wherein the stroke controlling unit includes a ROM (Read Only Memory) storing in advance a stroke value corresponded to a voltage/current phase difference inflection point.

7. The apparatus of claim 1, wherein the current flows into the motor, and the voltage is source voltage.

8. An apparatus for controlling operation of a reciprocating compressor, comprising:

an electric circuit unit operating a reciprocating compressor by varying a stroke with motion of a piston;

a phase difference detecting unit detecting a phase difference of a velocity and a current from the electric circuit unit;

a phase difference inflection point detecting unit detecting a phase difference inflection point by being inputted the phase difference; and a stroke controlling unit being inputted the detected phase difference infection point from the phase inflection point detecting unit and applying a voltage the electric circuit unit in order to make a stroke correspond to the phase difference inflection point.

9. The apparatus of claim 8, wherein the phase difference detecting unit includes a velocity/current detecting unit detecting a velocity and a current generated in the reciprocating compressor by the stroke variation of the reciprocating compressor.

10. The apparatus of claim 8, wherein the phase difference inflection point detecting unit detects a phase difference inflection point in which a TDC (Top Dead Center) is almost 0 by being inputted a velocity/current phase difference of the phase difference detecting unit and comparing it with a previous detected velocity/current phase difference.

11. The apparatus of claim 8, wherein the stroke controlling unit includes a microcomputer outputting a switching control signal to make a stroke correspond to the phase inflection point.

12. The apparatus of claim 8, wherein the stroke controlling unit includes a ROM (Read Only Memory) storing in advance a stroke value corresponded to a velocity/current phase difference inflection point.

13. A method for controlling operation of a reciprocating compressor, comprising:

a first process for detecting a voltage/current phase difference by detecting a voltage and a current generated in a reciprocating compressor;

a second process for comparing the present voltage/current phase difference detected in the first process with a previous detected voltage/current phase difference;

a third process for detecting a phase difference inflection point according to the voltage/current phase difference in the comparing result; and a fourth process for outputting a stroke corresponded to the detected phase inflection point to the reciprocating compressor.

14. The method of claim 13, wherein the stroke is decreased and the present voltage/current phase difference is stored as the previous value in the second process when the present voltage/current phase difference is larger than the previous voltage/current phase difference in the increase of the stroke.

15. The method of claim 13, wherein the stroke is increased and the present voltage/current phase difference is stored as the previous value in the second process when the present voltage/current phase difference is smaller than the previous voltage/current phase difference in the increase of the stroke.

16. The method of claim 13, wherein detecting the phase difference inflection point in the third process is detecting a point in which a TDC is almost 0 according to the voltage/current phase difference.

17. The method of claim 16, wherein the reciprocating compressor performs an avoidance operation above and below the point in which the TDC is almost 0 when a stroke tremble occurs in the TDC as 0.

18. The method of claim 13, wherein the current flowing into the motor is detected, and the voltage as source voltage is detected.

19. A method for controlling operation of a reciprocating compressor, comprising:

a first process for detecting a velocity/current phase difference by detecting a velocity and a current generated in a reciprocating compressor;

a second process for comparing the present velocity/current phase difference detected in the first process with a previous detected velocity/current phase difference;

a third process for detecting a phase difference inflection point according to the voltage/current phase difference in the comparing result; and a fourth process for outputting a stroke corresponded to the detected phase difference inflection point to the reciprocating compressor.

20. The method of claim 19, wherein the stroke is decreased and the present velocity/current phase difference is stored as the previous value in the second process when the present velocity/current phase difference is larger than the previous velocity/current phase difference in the increase of the stroke.

21. Tone method of claim 19, wherein the stroke is increased and the present velocity/current phase difference is stored as the previous value in the second process when the present velocity/current phase difference is smaller than the previous velocity/current phase difference in the increase of the stroke.

22. The method of claim 19, wherein detecting the phase difference inflection point in the third process is detecting a point in which a TDC is almost 0 according to the velocity/current phase difference.

23. The method of claim 22, wherein the reciprocating compressor performs an avoidance operation above and below the point in which the TDC is almost 0 when a stroke tremble occurs in the TDC as 0.

24. A method for controlling operation of a reciprocating compressor, comprising:

a first process for operating a reciprocating compressor with a fixed stroke and detecting a voltage/current phase difference at the operation;

a second process for judging a reference value of the phase difference detected in the first process by comparing it with a certain value ($\alpha$, $\beta$: $\alpha<\beta$)

a third process for judging whether a stroke tremble occurs in the operation of the reciprocating compressor with the fixed stroke when the reference value of the phase difference is smaller than a certain value (phase difference$<\alpha$) in the judging result of the second process; and a fourth process for operating the reciprocating compressor with the fixed stroke when the stroke tremble does not occur in the judging result of the third process.

25. The method of claim 24, further comprising:

judging whether a large refrigerating capacity is required when the stroke tremble occurs in the judging result of the third process;

performing an avoidance operation of the reciprocating processor above the stroke tremble region when the large refrigerating capacity is required; and performing an avoidance operation of the reciprocating compressor below the stroke tremble region when a small refrigerating capacity is required.

26. The method of claim 24, further comprising:

judging whether a stroke tremble occurs in the operation of the reciprocating compressor with the fixed stroke When the reference value of the phase difference is larger than the certain value (phase difference$>\beta$) in the judging result of the second process; and operating the reciprocating compressor with the fixed stroke when the stroke tremble does not occur.

27. The method of claim 26, further comprising:

performing an avoidance operation of the reciprocating compressor below the stroke tremble region when the stroke tremble occurs.

28. The method of claim 24, further comprising:

judging whether a stroke, tremble occurs in the operation of the reciprocating compressor with the fixed stroke having a phase inflection point when the reference value of the phase difference exists between certain values ($\alpha<$phase difference$<\beta$) in the judging result of the second process;

judging whether a large refrigerating capacity is required when the stroke tremble does not occur; and operating the stroke so as to make the TDC as 0 when the large refrigerating capacity is required.

29. The method of claim 28, further comprising:

operating the reciprocating compressor in a stroke smaller than the stroke occurring the phase difference inflection point when a small refrigerating capacity is required.

30. The method of claim 28, further comprising:

performing an avoidance operation above the stroke tremble region when a large refrigerating capacity is required when the stroke tremble occurs.

31. The method of claim 28, further comprising:

performing an avoidance operation below the stroke tremble region when a small refrigerating capacity is required when the stroke tremble occurs.

32. The method of claim 28, wherein the stroke is decreased when the present voltage/current phase difference is larger than the previous voltage/current. phase difference in the increase of the stroke, and the stroke is increased when the present voltage/current phase difference is smaller than the previous voltage/current phase difference in the increase of the stroke.

33. A method for detecting a phase of a reciprocating compressor, comprising:

a first process for detecting a first and a second zero voltages by sampling a first and a second analog signals with a certain sampling cycle;

a second process for generating a first and a second phase signals using the first and the second zero voltages detected in the first process; and a third process for detecting a phase difference signal by performing a logical operation of the first and the second phase signals generated in the second process.

34. The method of claim 33, wherein the first process includes:

a first step for judging whether an analog signal is smaller than a 'reference value +Δ' when the number of sampling is smaller than a half cycle in the counting of the number of sampling;

a second step for judging whether the analog signal is larger than a 'reference value −Δ' when the analog signal is smaller than the 'reference value +Δ';

a third step for storing the number of sampling between the 'reference value −Δ' and 'reference value +Δ' and times of sampling when the analog signal is larger than the 'reference value −Δ'; and a fourth step for detecting a zero voltage by dividing the number of sampling of the third step by the times of sampling.

35. The method of claim 33, wherein the second process includes:

a first step for generating a signal varied into a rising edge or a falling edge at the first and the second zero voltage positions; and a second step for generating a signal having an edge opposed to the signal generated in the first step by adding a half cycle to the generated signal and detecting a first and a second phase signals according to it.

36. The method of claim 33, wherein the phase difference signal of the third process is detected by performing an EXCLUSIVE OR operation of the first and the second phase signals.

37. The method of claim 36, wherein a phase difference is calculated by dividing the area of the phase difference signal by the total area of the phase difference signal about one cycle.

38. The method of claim 33, wherein the phase difference signal of the third process is detected by performing an AND operation of the first and the second phase signals.

39. The method of claim 33, wherein the phase difference signal of the third process is detected by performing an OR operation of the first and the second phase signals.

* * * * *